US007218184B2

(12) United States Patent
Yamanaka et al.

(10) Patent No.: US 7,218,184 B2
(45) Date of Patent: May 15, 2007

(54) SUPERCONDUCTING FILTER

(75) Inventors: Kazunori Yamanaka, Kawasaki (JP); Teru Nakanishi, Kawasaki (JP); Manabu Kai, Kawasaki (JP); Akihiko Akasegawa, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/949,808

(22) Filed: Sep. 27, 2004

(65) Prior Publication Data

US 2005/0261135 A1 Nov. 24, 2005

(30) Foreign Application Priority Data

May 19, 2004 (JP) ..... 2004-149271

(51) Int. Cl.
*H01P 1/203* (2006.01)

(52) U.S. Cl. ..... 333/99 S; 333/204; 505/210; 505/700; 505/866

(58) Field of Classification Search ..... 333/99 S, 333/202, 204; 505/210, 700, 866
See application file for complete search history.

(56) References Cited

U.S. PATENT DOCUMENTS 5,496,795 A * 3/1996 Das ..... 333/205
5,786,303 A * 7/1998 Mansour ..... 333/99 S
6,049,726 A * 4/2000 Gruenwald et al. ..... 505/210
6,108,569 A * 8/2000 Shen ..... 333/99 S
6,522,217 B1 * 2/2003 Shen ..... 333/99 S
6,741,142 B1 * 5/2004 Okazaki et al. ..... 333/99 S
6,778,042 B2 * 8/2004 Terashima et al. ..... 333/205

FOREIGN PATENT DOCUMENTS

| | | |
|---|---|---|
| JP | 10-224110 | 8/1998 |
| JP | 11-261307 | 9/1999 |
| JP | 2000-212000 | 8/2000 |
| JP | 2000-269704 | 9/2000 |
| JP | 2001-267806 | 9/2001 |
| JP | 2002-57506 | 2/2002 |
| JP | 2002-141706 | 5/2002 |
| JP | 2003-332812 | 11/2003 |

* cited by examiner

*Primary Examiner*—Benny T. Lee
*Assistant Examiner*—Kimberly E Glenn
(74) *Attorney, Agent, or Firm*—Armstrong, Kratz, Quintos, Hanson & Brooks, LLP

(57) ABSTRACT

A superconducting filter including input/output feeders formed on one surface of a dielectric substrate, resonator patterns formed on one surface of the dielectric substrate, and a dielectric plate mounted on the one surface of the dielectric substrate with a plurality of spacers formed on said one surface of the dielectric substrate disposed therebetween. The dielectric plate covers the region including the resonator patterns, and the input/output feeders length-wise over the length within ±20% of positive integer times a ¼ effective wavelength from the sides nearer to the resonator patterns.

20 Claims, 8 Drawing Sheets

SUPERCONDUCTING FILTER

CROSS-REFERENCE TO RELATED APPLICATIONS

This application is based upon and claims priority of Japanese Patent Application No. 2004-149271, filed on May 19, 2004, the contents being incorporated herein by reference.

BACKGROUND OF THE INVENTION

1. Field of the Invention

The present invention relates to a superconducting filter for radio-frequency signals.

2. Description of the Related Art

Various radio-frequency filters are used at mobile communication stations, etc. which treat signals of a some GHz frequency region. As the reception filter of the radio-frequency filters used in the mobile communication stations, etc., coaxial resonator-type, dielectric resonator-type, superconducting resonator-type, etc. are known. The reception filters of these types are required to realize downsizing and higher frequency selectivity.

The superconducting-type reception filter including as the circuit conductor a superconductor of an oxide high temperature superconductor or others can provide high no-load Q, which is advantageous in high frequency selectivity. On the other hand, as for the transmission filter, which treats large electric power, the superconducting-type cannot easily make downsizing and good electric power characteristics, etc., such as power resistance, etc. compatible with each other. The compatibility between both is a large problem.

In the downsizing, the filter of planar circuit-type is superior to the dielectric resonator-type, the coaxial resonator-type, etc. Furthermore, in the frequency region of below some GHz, where the mobile communication is relatively advantageous, the planar circuit-type filter using superconductor film of good YBCO, etc. can provide high no-load Q which is higher by places than the ordinary resonators using normal conductor film of, gold, silver, copper, etc., and can ensure high frequency selectivity.

In trying to downsize the planar circuit-type superconducting filter, the following methods have been so far studied. For example, the method of bending and deforming superconductor film line patterns to thereby decrease the area of a region where the resonator pattern is to be formed. The method of using a substrate of high dielectric constant as a substrate for resonator pattern conductors to be arranged to thereby increase the effective dielectric constant has been studied.

For the planar circuit-type superconducting filter, in trying to downsize the filter and improve the power characteristics as a power application, the following method has been studied. For example, the superconductor pattern of the resonance circuit is in circular, polygonal or other patches to thereby mitigate the current density concentration by TM mode or others has been studied. The method of controlling the grain boundary, the impurity or others of oxide high temperature superconductor film to thereby develop better oxide high temperature superconductor film to be used as the circuit conductors has been studied.

Furthermore, the method of using a hybrid structure of the planar circuit type and dielectric substances except the dielectric substances of the substrate to thereby mitigate the concentration of current density on the superconductor has been studied.

Non-Patent References 1 to 3 listed below disclose the techniques of forming planar circuits, such as coplanar circuits, microstrip line circuits, etc., using oxide high temperature superconductor films such as copper oxide high temperature superconductor films to thereby form passive circuits, such as radio-frequency filters, etc.

For the reception radio-frequency filters of the superconducting filters including oxide superconductors, it is an important problem to be downsized as much as possible. For the transmission radio-frequency filters treating high power, it is an important problem, in addition to downsizing, to improve the power characteristics as much as possible.

Following references disclose the background art of the present invention.

[Patent Reference 1]

Japanese published unexamined patent application No. 2002-57506

[Patent Reference 2]

Japanese published unexamined patent application No. 2003-332812

[Patent Reference 3]

Japanese published unexamined patent application No. 2000-269704

[Patent Reference 4]

Japanese published unexamined patent application No. Hei 11-261307 (1999)

[Patent Reference 5]

Japanese published unexamined patent application No. 2002-141706

[Patent Reference 6]

Japanese published unexamined patent application No. 2001-267806

[Patent Reference 7]

Japanese published unexamined patent application No. 2000-212000

[Patent Reference 8]

Japanese published unexamined patent application No. Hei 10-224110 (1998)

[Non-Patent Reference 1]

M. Hein, High-Temperature-superconductor Thin Films at Microwave Frequencies, Springer, 1999

[Non-Patent Reference 2]

Alan M Portis, Electrodynamics of High-Temperature Superconductors, World Scientific, 1992

[Non-Patent Reference 3]

Zhi-Yuan She, High-Temperature Superconducting Microwave Circuits, Artech House, 1994

SUMMARY OF THE INVENTION

An object of the present invention is to provide a superconducting filter which can realize improved power characteristics with good repeatability and can be easily downsized.

According to one aspect of the present invention, there is provided a superconducting filter comprising: a dielectric substrate; a first input/output feeder formed on one surface of the dielectric substrate and formed of a superconductor film, for inputting a radio-frequency signal; a resonator pattern formed on said one surface of the dielectric substrate and formed of a superconductor film, for filtering the radio-frequency signal inputted from the first input/output feeder; a second input/output feeder formed on said one surface of the dielectric substrate and formed of a superconductor film, for outputting the radio-frequency signal filtered by the resonator pattern; and a dielectric body mounted on said one surface of the dielectric substrate with a plurality of spacers disposed therebetween, the dielectric body covering a region including the resonator pattern, the first input/output feeder over a length within ±20% of positive integer times a ¼ effective wavelength from a side nearer to the resonator pattern, and the second input/output feeder over a length within ±20% including ±20% of positive integer times the ¼ effective wavelength from a side nearer to the resonator pattern.

According to the present invention, in the superconducting filter comprising: a dielectric substrate; a first input/output feeder formed on one surface of the dielectric substrate and formed of a superconductor film, for inputting a radio-frequency signal; a resonator pattern formed on said one surface of the dielectric substrate and formed of a superconductor film, for filtering the radio-frequency signal inputted from the first input/output feeder; a second input/output feeder formed on said one surface of the dielectric substrate and formed of a superconductor film, for outputting the radio-frequency signal filtered by the resonator pattern; and a dielectric body mounted on said one surface of the dielectric substrate with a plurality of spacers disposed therebetween, the dielectric body covers a region including the resonator pattern, the first input/output feeder over a length within ±20% of positive integer times a ¼ effective wavelength from a side nearer to the resonator pattern, and the second input/output feeder over a length within ±20% including ±20% of positive integer times the ¼ effective wavelength from a side nearer to the resonator pattern, whereby the superconducting filter can be small sized. The reflection of the radio-frequency signals can be depressed, and the impedance matching between the circuit patterns can be easily made. Thus, the reactive power of the radio-frequency signals inputted and outputted to and from the superconducting filter can be decreased, and the power characteristics can be improved.

Furthermore, according to the present invention, the dielectric body is mounted on one surface of the dielectric substrate by first spacers which are plastically deformable and secure the dielectric body mounted on one surface of the dielectric substrate and second spacers for defining the width of the gap between the dielectric substrate and the dielectric body, whereby the power characteristics can be improved with high repeatability.

DETAILED DESCRIPTION OF THE EXEMPLARY EMBODIMENTS

A First Embodiment

Figure 1:
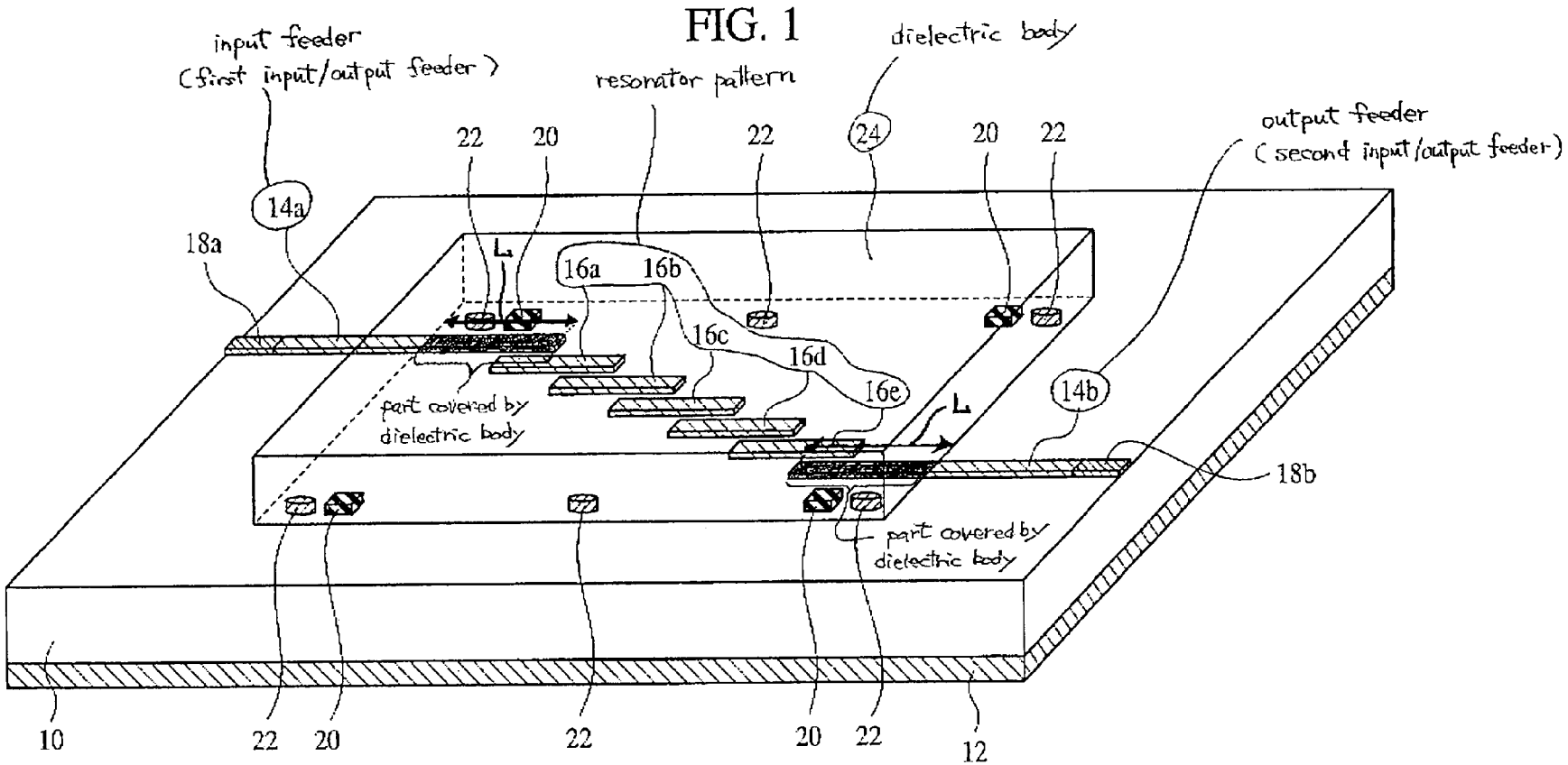
FIG. 1 is a perspective view of the superconducting filter according to a first embodiment of the present invention, which illustrates a structure thereof.
Figure 2:
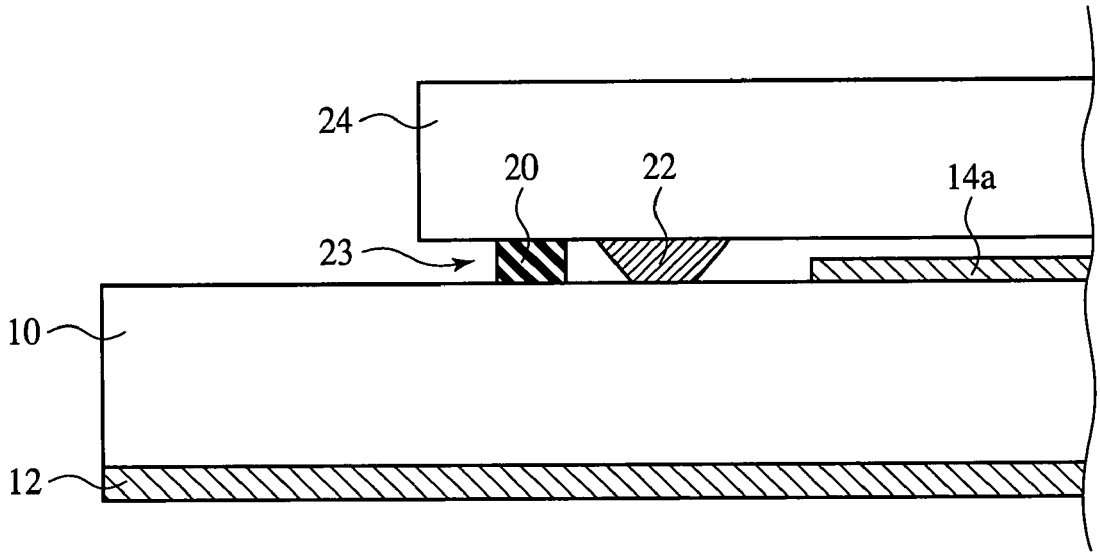
FIG. 2 is an enlarged sectional view of the superconducting filter according to the first embodiment of the present invention, which illustrates the structure near the spacers.

The superconducting filter according to a first embodiment of the present invention will be explained with reference to FIGS. 1 and 2. FIG. 1 is a perspective view of the superconducting filter according to the present embodiment, which illustrates a structure thereof. FIG. 2 is an enlarged sectional view of the structure of the superconducting filter according to the present embodiment, which illustrates the structure near the spacers.

The superconducting filter according to the present embodiment is a band-pass filter of the planar circuit type having the microstrip line transmission line structure and has an operational temperature of, e.g., below 100 K including 100 K.

As illustrated in FIG. 1, on the underside of a dielectric substrate 10 of magnesium oxide (110) single crystal, a ground plane 12 of a $YBa_2Cu_3O_{7-\delta}$ (YBCO) superconductor film is deposited by, e.g., epitaxial growth.

On the upper surface of the dielectric substrate 10 there are formed input/output feeders 14*a*, 14*b* one of which radio-frequency signals are inputted to and the other of which the filtered radio-frequency signals are outputted from. On the upper surface of the dielectric substrate 10, there are formed rectangular ½ wavelength resonator patterns 16*a*–16*e* which filter radio-frequency signals inputted to one of the input/output feeders 14*a*, 14*b* and output the filtered radio-frequency signals to the other of the input/output feeders 14*a*, 14*b*. The input/output feeders 14*a*, 14*b* and the resonator patterns 16*a*–16*e* are formed of, e.g., a 0.4–1 μm-thickness YBCO superconductor film deposited by, e.g., epitaxial growth.

The input/output feeders 14*a*, 14*b* are formed along a prescribed direction respectively near the opposed ends of the upper surface of the dielectric substrate 10. Electrodes 18*a*, 18*b* respectively of a silver film are formed on the ends of the input/output feeders 14*a*, 14*b* on the side of the boundary edge of the dielectric substrate 10.

The resonator patterns 16*a*–16*e* having a length of ½ of the effective wavelength (½ effective wavelength) which is the effective wavelength of the radio-frequency signal in the transmission line of the superconducting filter are arranged in the direction of the arrangement of the input/output feeders 14*a*, 14*b* in steps which are offset from each other by a length of ¼ of the effective wavelength (¼ effective wavelength) which is the effective wavelength of the radio-frequency signal in the transmission line of the superconducting filter. The resonator patterns 16*a*, 16*e* of the resonator patterns 16*a*–16*e*, which are on both ends of the arrangement thereof are opposed respectively to the input/output feeders 14*a*, 14*b*.

Thus, a resonance circuit having the microstrip transmission line structure including YBCO superconductor as the circuit conductor is formed on the dielectric substrate 10.

On the upper surface of the dielectric substrate 10 with the input/output feeders 14*a*, 14*b* and the resonator patterns 16*a*–16*e* formed on, there is mounted a dielectric plate 24 of magnesium oxide with spacers 20 of polyimide and spacers 22 in the form of indium bumps. The spacers 20 of polyimide are disposed at positioned near the 4 corners of the dielectric plate 24. The spacers 22 in the form of indium bumps are disposed at positions near the 4 corners of the dielectric plate 24 and at positions near the respective mediums of a pair of opposed edges of the dielectric plate 24.

The indium bumps forming the spacers 22 is plastically easily deformable and viscous not only at the room temperature but also at low temperatures of, e.g., below 100 K including 100 K. The dielectric plate 24 is secured to the upper surface of the dielectric substrate 10 by the spacers 22 of such indium bumps.

As illustrated in FIG. 2, the spacers 20 of polyimide and the spacers 22 in the form of indium pumps define a gap 23, e.g., a 0.5–4 μm-width between the dielectric substrate 10 and the dielectric plate 24. The width of the gap 23 is determined by the thickness of the spacers 20 of polyimide.

The dielectric plate 24 mounted on the dielectric substrate 10 with the spacers 20, 22 disposed therebetween covers the region including the resonator patterns 16*a*–16*e* as illustrated in FIG. 1. The dielectric plate 24 covers the input/output feeder 14*a* length-wise from the side nearer to the resonator pattern 16*a* over a length which is positive integer times the ¼ effective wavelength. Similarly, the dielectric plate 24 covers the input/output feeder 14*b* length-wise from the side nearer to the resonator pattern 16*e* over a length which is positive integer times the ¼ effective wavelength.

The superconducting filter according to the present embodiment is characterized in that the dielectric plate 24 is mounted on the upper surface of the dielectric substrate 10 with the planar circuit-type resonance circuit including YBCO superconductor film formed on, with the spacers 20, 22 disposed therebetween, and the dielectric plate 24 covers the regions including the resonator patterns 16*a*–16*e*, and the input/output feeders 14*a*, 14*b* over a length which is positive integer times the ¼ effective wavelength respectively from the resonator patterns 16*a*, 16*e*.

The region including the resonator patterns 16*a*–16*e*, which is covered with the dielectric plate 24, has a higher effective dielectric constant around the resonator patterns 16*a*–16*e* in comparison with the region without the dielectric plate 24. Accordingly, the size of the resonator patterns 16*a*–16*e* can be made smaller, which can make the superconducting filter smaller. For example, the area of the region for the resonance circuit formed in can be decreased by, e.g., about 20% in comparison with the area without the dielectric plate 24.

The input/output feeders 14*a*, 14*b* are covered by the dielectric plate 24 length-wise over a length which is positive integer times the ¼ effective wavelength from the sides nearer to the resonator patterns 16*a*, 16*b*, whereby the reflection of radio-frequency signals can be suppressed, and the impedance matching between the circuit patterns can be made. Accordingly, the reactive power of the radio-frequency signals inputted/outputted in and from the superconducting filter can be decreased, and the power characteristics can be improved.

The effective wavelength defining the length of the parts of the input/output feeders 14*a*, 14*b* covered by the dielectric plate 24 is determined by the thickness of the dielectric substrate 10, the width of the gap 23 between the dielectric substrate 10 and the dielectric plate 24, the thickness of the dielectric plate 24, the dielectric constant of the dielectric substrate 10, the dielectric constant of the gap 23 (air) between the dielectric substrate 10 and the dielectric plate 24 and the dielectric constant of the dielectric plate 24.

The ¼ effective wavelength which is the length of the parts of the input/output feeders 14*a*, 14*b* covered by the dielectric plate 24 in the case where the superconducting filter according to the present embodiment is the band-pass filter of a 4 GHz passing center frequency can be estimated as follows. The dielectric constant of oxide magnesium forming the dielectric substrate 10 and the dielectric plate 24 is about 9.7 at the operating temperature of ten's K. Accordingly, for 4 GHz frequency, in the space sandwiched between the dielectric substrate 10 and the dielectric plate 24, when the width of the gap 23 between the dielectric substrate 10 and the dielectric plate 24 is 0.5–4 μm, the ½ effective wavelength is about 1.1–1.2 cm depending on the gap 23. Accordingly, in this case, the length of the parts of the input/output feeders 14*a*, 14*b* covered by the dielectric plate 24 is about 0.55–0.6 cm which is the ¼ effective wavelength. In the space which is not sandwiched between the dielectric substrate 10 and the dielectric plate 24, the ½ effective wavelength is about 1.5 cm.

The length of the parts of the input/output feeders 14*a*, 14*b* covered by the dielectric plate 24 does not have to be essentially accurately positive integer times the ¼ effective wavelength and can be, e.g., within ±20% of positive integer times the ¼ effective wavelength.

The superconducting filter according to the present embodiment is characterized in that the dielectric plate 24 is secured to the upper surface of the dielectric substrate 10 by the spacers 22 in the form of indium bumps, which is easily plastically deformable not only at the room temperature but also at a temperature of, e.g., below 100 K including 100 K.

When stresses due to cooling from the room temperature to the operating temperature or other causes, or mechanical stresses are applied to the superconducting filter, the spacers 22 in the form of indium bumps are plastically deformed to thereby mitigate the stresses.

Furthermore, the dielectric plate 24 is mounted on the upper surface of the dielectric substrate 10 with the spacers 20 of polyimide in addition to the spacers 22 in the form of indium bumps, which are plastically deformed to thereby mitigate the stresses, formed therebetween, whereby when the stresses due to the temperature change and mechanical stresses are applied to the superconducting filter, the width between the dielectric substrate 10 and the dielectric plate 24 can be retained substantially constant. The thickness of the spacers 20 of polyimide are suitably set, whereby the width of the gap 23 between the dielectric substrate 10 and the dielectric plate 24 can be adjusted to be a prescribed value.

As described above, in the superconducting filter according to the present embodiment, the dielectric plate 24 is mounted on the upper surface of the dielectric substrate 10 with 2 kinds of spacers, i.e., the spacers 20 defining the width of the gap 23 between the dielectric substrate 10 and the dielectric plate 24 and the plastically deformable spacers 22 securing the dielectric plate 24 on the upper surface of the dielectric substrate 10, whereby the offset between the dielectric substrate 10 and the dielectric plate 24 and changes of the width of the gap 23 between the dielectric substrate 10 and the dielectric plate 24 can be depressed. For example, when the width of the gap 23 between the dielectric substrate 10 and the dielectric plate 24 is set at 2 μm, the change of the width of the gap 23 can be suppressed to be below 0.02 μm including 0.02 μm. Accordingly, the power characteristics can be improved with high repeatability. For example, the effect of mitigating the concentration of the current density on the input/output feeders 14*a*, 14*b* and the ends of the resonator patterns 16*a*–16*e* can be stably obtained. Furthermore, the effect of strengthening the electromagnetic field coupling between the input/output feeder 14*a* and the resonator pattern 16*a* and between the input/ output feeder 14*b* and the resonator pattern 16*e*, and strengthening the electromagnetic field coupling between the input/output feeders 14*a*, 14*b* and outside circuits can be stably obtained.

The spacers 20, 22 disposed between the dielectric substrate 10 and the dielectric plate 24 are formed as follows.

The spacers 20 of polyimide are formed by photolithography, lithography using electron beams or others on the upper surface of the dielectric substrate 10 or the surface of the dielectric plate 24 opposed to the dielectric substrate 10 at the prescribed positions before the dielectric plate 24 is mounted on the upper surface of the dielectric substrate 10. The thickness of the spacers 20 of polyimide is equal to or larger than the film thickness of the YBCO superconductor film forming the input/output feeders 14*a*, 14*b* and the resonator patterns 16*a*–16*e*, specifically, e.g., 0.5–10 μm.

The spacers 22 in the form of indium bumps are formed by deposition using a mask on the upper surface of the dielectric substrate 10 or the surface of the dielectric plate 24 opposed to the dielectric substrate 10 at the prescribed positions before the dielectric plate 24 is mounted on the upper surface of the dielectric substrate 10. Otherwise, the spacers 22 are formed by heat welding indium balls on the upper surface of the dielectric substrate 10 or the surface of the dielectric plate opposed to the dielectric substrate 10 at the prescribed positions. The thickness of the spacers 22 in the form of indium bumps is larger than the thickness of the spacers 20 of polyimide.

The spacers 20 of polyimide and the spacers 22 in the form of indium bumps may be formed either of the dielectric substrate 10 or the dielectric plate 24 before the dielectric plate 24 is mounted on the upper surface of the dielectric substrate 10. In the case where the spacers 20, 22 are formed on the dielectric substrate 10, however, there is a risk that the resonance circuit formed on the upper surface of the dielectric substrate 10 may be damaged by the processing for forming the spacers 20, 22. Preferably, the spacers 20, 22 are formed on the dielectric plate 24 before the dielectric plate 24 is mounted on the upper surface of the dielectric substrate 10.

With the spacers 20, 22 thus formed at the prescribed positions, the dielectric plate 24 is mounted o the upper surface of the dielectric substrate 10, whereby the gap 23 of a prescribed width can be defined between the dielectric substrate 10 and the dielectric plate 24. At this time, the spacers 22 in the form of indium bumps, which have been formed thicker than the spacers 20 of polyimide, are plastically deformed to have the thickness equal to the thickness of the spacers 20 of polyimide. The viscosity of the spacers 22 in the form of indium bumps secures the dielectric plate 24 to the upper surface of the dielectric substrate 10.

When the size of the spacers 22 provided on the upper surface of the dielectric substrate 10 is too large, the spacers 22 often interfere with the resonance circuit. The maximum size of the spacers 22 on the upper surface of the dielectric substrate 10 is preferably below 1 mm including 1 mm.

The positions for the spacers 20, 22 to be arranged at, and the numbers of the spacers 20, 22 to be arranged may be suitably changed in design in accordance with the size of the dielectric plate 24, etc.

As described above, according to the present embodiment, the region including the resonator patterns 16*a*–16*e*, and the parts of the input/output feeder lines 14*a*, 14*b* which are positive integer times the ¼ effective wavelength from the sides of the resonator patterns 16*a*, 16*b* are covered by the dielectric plate 24 mounted on the dielectric substrate 10 with the spacers 20 of polyimide and the spacers 22 in the form of indium bumps, whereby the superconducting filter can be downsized and have the power characteristics improved with high repeatability.

A Second Embodiment

Figure 3:
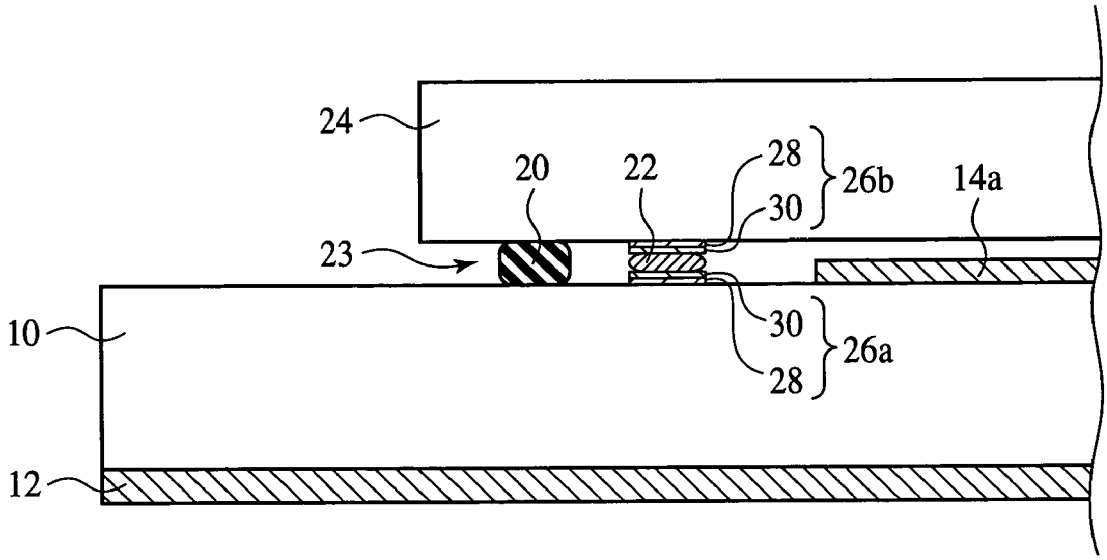
FIG. 3 is an enlarged sectional view of the superconducting filter according to a second embodiment of the present invention, which illustrates the structure near the spacers.

The superconducting filter according to a second embodiment of the present invention will be explained with reference to FIG. 3. FIG. 3 is an enlarged sectional view of the superconducting filter according to the present embodiment, which illustrates the structure near spacers. The same members of the present embodiments as those of the superconducting filter according to the first embodiment are represented by the same reference numbers not to repeat or to simplify their explanation.

The basic structure of the superconducting filter according to the present embodiment is substantially the same as that of the superconducting filter according to the first embodiment. The superconducting filter according to the present embodiment is different from the superconducting filter according to the first embodiment in that in the former, the spacers 22 in the form of indium bumps are sandwiched by metal pads formed respectively on the upper surface of the dielectric substrate 10 and the surface of the dielectric plate 24 opposed to the dielectric substrate 10.

As illustrated in FIG. 3, the metal pads 26*a*, 26*b* are formed respectively on the upper surface of the dielectric substrate 10 and the underside of the dielectric plate 24 at the positions where the spacers 22 in the form of indium bumps are arranged. The spacers 22 in the form of indium bumps are sandwiched by the metal pads 26*a*. 26*b*.

The metal pads 26*a*, 26*b* are each formed of a layer structure of a base metal layer 28 and a metal layer 30 for the spacer 22 in the form of an indium bump to be contacted with. The base metal layer 28 can be formed of, e.g., nickel, titanium or others. The metal layer 30 for the spacer 22 to be contacted with can be formed of, e.g., gold, silver, copper or others. The metal pads 26*a*, 26*b* may be formed of the same metal film that forms the electrodes 18*a*, 18*b*.

As described above, the superconducting filter according to the present embodiment is characterized in that the spacers 22 in the form of indium bumps are sandwiched by the metal pads 26*a*, 26*b* formed respectively on the upper surface of the dielectric substrate 10 and the underside of the dielectric plate 24 opposed to each other. Because of the metal pads 26*a*, 26*b* formed respectively on the upper surface of the dielectric substrate 10 and the underside of the dielectric plate 24 opposed to each other at the positions where the spacers 22 in the form of indium bumps are arranged, the dielectric plate 24 can be mounted on the dielectric substrate 10 with high positioning precision. In the superconducting filter according to the present embodiment, the spacers 22 in the form of indium bumps, which are metal, are in contact with the metal surfaces, whereby the dielectric substrate 10 and the dielectric plate 24 can be fixed to each other more securely in comparison with the case where the spacers 22 in the form of indium bumps are in direct contact with the dielectric substrate 10 and the dielectric plate 24. This permits the power characteristics to be improved with higher repeatability.

In the superconducting filter according to the present embodiment, the metal pads 26*a*, 26*b* are formed on the upper surface of the dielectric substrate 10 and the underside of the dielectric plate 24 opposed to each other at prescribed positions, and the spacers 22 in the form of indium pumps are welded by heating onto either of the metal pads 26*a*, 26*b* before the dielectric plate 24 is mounted on the upper surface of the dielectric substrate 10. The spacers 20 of polyimide have been formed in the same way as in the superconducting filter according to the first embodiment. Then, the dielectric plate 24 is mounted on the upper surface of the dielectric substrate 10 with the metal pads 26*a* on the upper surface of the dielectric substrate 10 in alignment with the metal pads 26*b* on the underside of the dielectric plate 24.

In the present embodiment, the metal pads 26*a*, 26*b* are formed respectively on the upper surface of the dielectric substrate 10 and the underside of the dielectric plate 24 opposed to each other. However, both the metal pad 26*a* and the metal pad 26*b* are not essentially formed, and the metal pad may be formed on either of the upper surface of the dielectric substrate 10 and the underside of the dielectric plate 24. In this case, before the dielectric plate 24 is mounted on the upper surface of the dielectric substrate 10, the spacers 22 in the form of indium bumps are welded by heating on the metal pads formed on either of the upper surface of the dielectric substrate 10 and the underside of the dielectric plate 24.

A Third Embodiment

Figure 4:
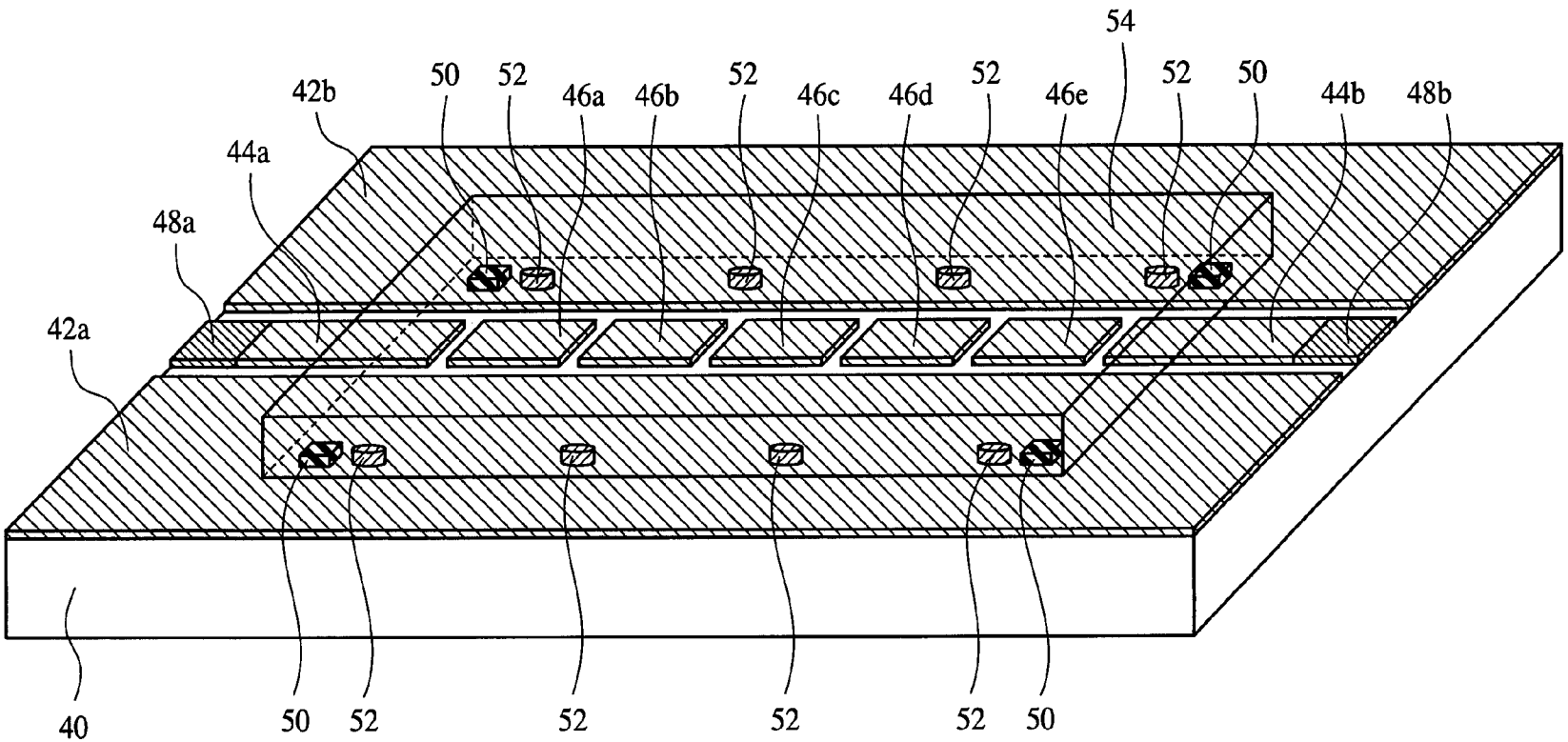
FIG. 4 is a perspective view of the superconducting filter according to a third embodiment of the present invention.
Figure 5:
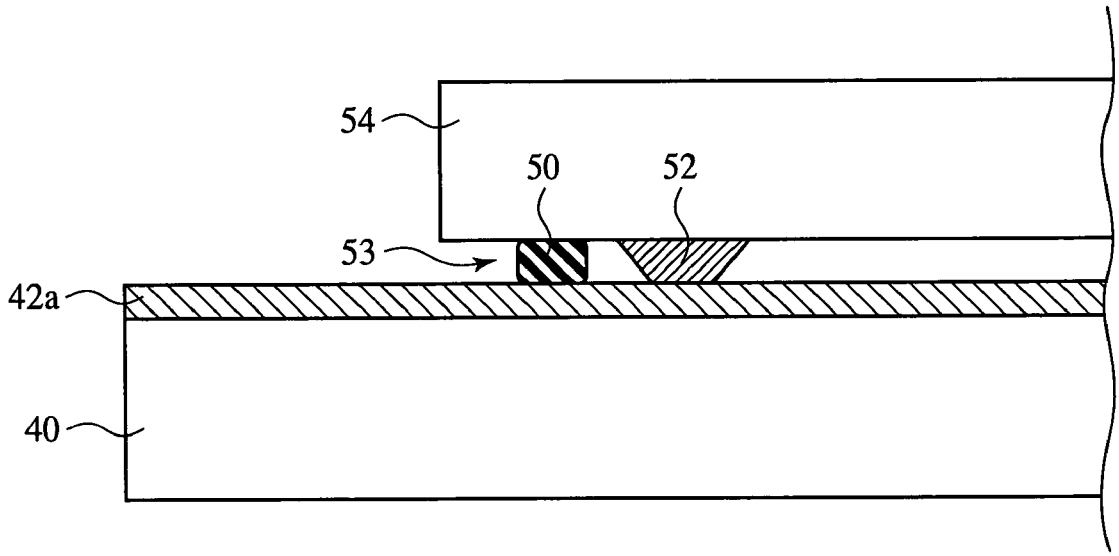
FIG. 5 is an enlarged sectional view of the superconducting filter according to the third embodiment of the present invention, which illustrates the structure near the spacers.

The superconducting filter according to a third embodiment of the present invention will be explained with reference to FIGS. 4 and 5. FIG. 4 is a perspective view of the superconducting filter according to the present embodiment, which illustrates a structure thereof. FIG. 5 is an enlarged sectional view of the superconducting filter according to the present embodiment, which illustrates the structure near spacers.

The superconducting filter according to the present embodiment is a band-pass filter of the planar circuit type having the coplanar waveguide structure, and the operating temperature is, e.g., below 100 K including 100 K.

As illustrated in FIG. 4, a pair of ground planes 42*a*, 42*b* are formed on the upper surface of a dielectric substrate 40 of magnesium oxide, spaced from each other. The ground planes 42*a*, 42*b* are formed of $DyBa_2Cu_3O_{7-\delta}$ (DyBCO) superconductor film deposited by, e.g., epitaxial growth.

In the region of the upper surface of the dielectric substrate 40, which is between the ground planes 42*a*, 42*b*, there are formed input/output feeders 44*a*, 44*b* one end of which radio-frequency signals are inputted to and the other end of which the filtered radio-frequency signals are outputted from. In the region of the upper surface of the dielectric substrate 40, which is between the input/output feeders 44*a*, 44*b* rectangular ½ wavelength type resonator patterns 46*a*–46*e* which filters radio-frequency signals inputted to one end of the input/output feeders 44*a*, 44*b* and outputs the filtered radio-frequency signals to the other end of the input/output feeders 44*a*, 44*b*. The input/output feeders 44*a*, 44*b* and the resonator patterns 46*a*–46*e* are formed of, e.g., a 0.4–1 μm-DyBCO superconductor film deposited by, e.g., epitaxial growth.

The input/output feeders 44*a*, 44*b* are formed in a prescribed direction respectively near the opposed ends of the upper surface of the dielectric substrate 40. Electrodes 48*a*, 48*b* of nickel film are formed at the ends of the input/output feeders 44*a*, 44*b* nearer the boundary edge of the dielectric substrate 40.

The resonator patterns 46*a*–46*e* are formed in the region of the upper surface of the dielectric substrate 10, which is sandwiched by the input/output feeders 44*a*, 44*b*. The resonator patterns 46*a*–46*e* are equidistantly arranged in the same direction as the input/output feeders 44*a*, 44*b* are arranged.

Thus, the resonance circuit having the coplanar waveguide structure using DyBCO superconductor as the circuit conductor is formed on the dielectric substrate 40.

A dielectric plate 54 of rutile titanium oxide is mounted on the upper surface of the dielectric substrate 40 with the ground planes 42*a*, 42*b*, the input/output feeders 44*a*, 44*b* and the resonator patterns 46*a*–46*e* formed on with spacers 50 of cyclized rubber resin and spacers 52 in the form of indium-silver alloy bumps formed therebetween. The silver content of the indium-silver alloy forming the spacers 52 is, e.g., 1 wt %. The spacers 50 of cyclized rubber are disposed at positions near the 4 corners of the dielectric plate 54. The spacers 52 in the form of indium-silver alloy bumps are disposed equidistantly near and along a pair of opposed sides of the dielectric plate 54.

The indium-silver alloy bumps forming the spacers 52 are easily plastically deformable and viscous not only at the room temperature but also a temperature of, e.g., below 100 K including 100 K, as are the indium bumps. The dielectric plate 54 is secured to the upper surface of the dielectric substrate 40 by the spacers 52 in the form of such indium-silver alloy bumps.

As illustrated in FIG. 5, the gap 53 of, e.g., a 0.7–10 μm-width is defined between the dielectric substrate 40 and the dielectric plate 54 by the spacers 50 of cyclized rubber resin and the spacers 52 in the form of indium-silver alloy bumps. The width of the gap 53 is determined by the thickness of the spacers 20 of cyclized rubber resin.

As illustrated in FIG. 4, the dielectric plate 54 covers the region including the resonator patterns 46*a*–46*e*. Furthermore, the dielectric plate 54 covers the input/output feeder 44*a* length-wise over the length of positive integer times a ¼ effective wavelength from the side of the input/output feeder 44*a* nearer to the resonator pattern 46*a*. Similarly, the dielectric plate 54 covers the input/output feeder 44*b* length-wise over the length of positive integer times the ¼ effective wavelength from the side of the input/output feeder 44*b* nearer to the resonator pattern 46*b*.

The superconducting filter according to the present embodiment is characterized in that the dielectric plate 54 is mounted on the upper surface of the dielectric substrate 40 with the planar circuit type resonance circuit of DyBCO superconductor film with the spacers 50, 52 formed therebetween, and the dielectric plate 54 covers the region including the resonator patterns 46*a*–46*e* and covers the input/output feeders 44*a*, 44*b* over the length of positive integer times the ¼ effective wavelength from the side thereof nearer to the resonator patterns 46*a*, 46*e*.

With the region including the resonator patterns 46*a*–46*e* covered with the dielectric plate 54, the effective dielectric constant around the resonator patterns 46*a*–46*e* is higher in comparison with the effective dielectric constant with the resonator patterns 46*a*–46*e* not covered by the dielectric plate 54. Accordingly, the size of the resonator patterns 46*a*–46*e* can be smaller, and the superconducting filter can be downsized. For example, the area of the region for the resonance circuit formed in can be decreased by, e.g., about 60% in comparison with the area with the dielectric substrate 54 not mounted.

The dielectric substrate 54 covers the input/output feeders 44*a*, 44*b* over the length by positive integer times the ¼ effective wavelength from the sides nearer to the resonator patterns 46*a*, 46*b*, whereby the reflection of radio-frequency signals can be depressed, and the impedance matching between the circuit patterns can be easily made. Accordingly, the reactive power of the radio-frequency signals inputted and outputted to and from the superconducting filter can be decreased, and the power characteristics can be improved.

The effective wavelength defining the length of the parts of the input/output feeders 44*a*, 44*b* covered by the dielectric plate 54 is determined by the thickness of the dielectric substrate 40, the width of the gap 53 between the dielectric substrate 40 and the dielectric plate 54, the thickness of the dielectric plate 54, the dielectric constant of the dielectric substrate 40, the dielectric constant of the gap 53 (air) between the dielectric substrate 40 and the dielectric plate 54 and the dielectric constant of the dielectric plate 54.

The ¼ effective wavelength which is the length of the parts of the input/output feeders 44*a*, 44*b* covered by the dielectric plate 54 in the case where the superconducting filter according to the present embodiment is the band-pass filter of a 4 GHz passing center frequency can be estimated as follows. In the following estimation, the thickness of the dielectric substrate 40 is 1.0 mm, the thickness of the dielectric plate 54 is, 1.0 mm, and the width of the gap 53 between the ground planes 42*a* the ground plane 42*b* is 0.4 mm. At the operating temperature of 10's K, magnesium oxide forming the dielectric substrate 40 is about 9.7, and the dielectric constant of rutile titanium oxide forming the dielectric plate 54 is about 100. For 4 GHz frequency, in the space sandwiched by the dielectric substrate 40 and the dielectric plate 54, when the width of the gap 53 between the dielectric substrate 40 and the dielectric plate 54 is 0.7–10 μm, the ½ effective wavelength is about 0.4–0.6 cm depending on the gap 53. Accordingly, in this case, the length of the parts of the input/output feeders 44*a*, 44*b* covered by the dielectric plate 54 is about 0.2–0.3 cm which is the ¼ effective wavelength. In the space which is not sandwiched between the dielectric substrate 40 and the dielectric plate 54, the ½ effective wavelength is about 1.6 cm.

The length of the parts of the input/output feeders 44*a*, 44*b* covered by the dielectric plate 54 does not have to be essentially accurately positive integer times the ¼ effective wavelength and can be, e.g., within ±20% of positive integer times the ¼ effective wavelength.

The superconducting filter according to the present embodiment is characterized in that the dielectric plate 54 is secured to the upper surface of the dielectric substrate 40 by the spacers 52 in the form of bumps of indium-silver alloy, which is easily plastically deformable not only at the room temperature but also at a temperature of, e.g., below 100 K including 100 K.

When stresses due to cooling from the room temperature to the operating temperature or other causes, or mechanical stresses are applied to the superconducting filter, the spacers 52 in the form of indium-silver alloy bumps are plastically deformed to thereby mitigate the stresses.

Furthermore, the dielectric plate 24 is mounted on the upper surface of the dielectric substrate 10 with the spacers 52 in the form of bumps of indium-silver alloy, which are plastically deformed to thereby mitigate the stresses, and the spacers 50 of cyclized rubber resin, formed therebetween, whereby when the stresses due to the temperature change and mechanical stresses are applied to the superconducting filter, the width of gap 53 between the dielectric substrate 40 and the dielectric plate 54 can be retained substantially constant. The thickness of the spacers 50 of cyclized rubber resin is suitably set, whereby the width of the gap 53 between the dielectric substrate 40 and the dielectric plate 54 can be adjusted to be a prescribed value.

As described above, in the superconducting filter according to the present embodiment, the dielectric plate 54 is mounted on the upper surface of the dielectric substrate 40 by 2 kinds of spacers, i.e., the spacers 50 for defining the width of the gap 53 between the dielectric substrate 40 and the dielectric plate 54 and the plastically deformable spacers 52 for securing the dielectric plate 54 mounted on the upper surface of the dielectric substrate 40, whereby the offset between the dielectric substrate 40 and the dielectric plate 54 and changes of the width of the gap 53 between the dielectric substrate 40 and the dielectric plate 54 can be depressed. For example, when the width of the gap 53 between the dielectric substrate 40 and the dielectric plate 54 is set at 2 μm, the change of the width of the gap 53 can be suppressed to be below 0.02 μm including 0.02 μm. Accordingly, the power characteristics can be improved with high repeatability. For example, the effect to mitigating the concentration of the current density on the input/output feeders 44*a*, 44*b* and the ends of the resonator patterns 46*a*–46*e* can be stably obtained. Furthermore, the effect of strengthening the electromagnetic field coupling between the input/output feeder 44*a* and the resonator pattern 46*a* and between the input/output feeder 44*b* and the resonator pattern 46*e*, and strengthening the electromagnetic field coupling between the input/output feeders 44*a*, 44*b* and outside circuits can be stably obtained.

The spacers 50, 52 disposed between the dielectric substrate 40 and the dielectric plate 54 are formed as follows in the same way as the spacers 20, 22 of the superconducting filter according to the first embodiment.

The spacers 50 of clyclized rubber resin are formed by photolithography, lithography using electron beams or others on the upper surface of the dielectric substrate 40 or on the underside of the dielectric plate 54 opposed to the dielectric substrate 40 at the prescribed positions before the dielectric plate 54 is mounted on the dielectric substrate 40. The thickness of the spacers 50 of the clyclized rubber resin is equal to or larger than the film thickness of the DyBCO superconductor film forming the ground planes 42*a*, 42*b*, the input/output feeders 44*a*, 44*b* and the resonator patterns 46*a*–46*e*, specifically, e.g., 0.5–10 μm.

The spacers 52 in the form of indium-silver alloy bumps are formed on the upper surface of the dielectric substrate 40 or the surface of the dielectric plate 54 opposed to the dielectric substrate 40 by deposition using a mask before the dielectric plate 54 is mounted on the dielectric substrate 40 at the prescribed positions. Otherwise, the spacers 52 are formed by heat welding indium-silver alloy balls onto the upper surface of the dielectric substrate 40 or the surface of the dielectric plate 54 opposed to the dielectric substrate 40 at the prescribed positions. The thickness of the spacers 52 of indium-silver alloy bumps is larger than the thickness of the spacers 50 of cyclized rubber resin.

The spacers 50 of clyclized rubber resin and the spacers 52 in the form of indium-silver alloy bumps may be formed either on the dielectric substrate 40 or the dielectric plate 54 before the dielectric plate 54 is mounted on the dielectric substrate 40. However, in the case where the spacers 50, 52 are formed on the dielectric substrate 40, there is a risk that the resonance circuit formed on the upper surface of the dielectric substrate 40 may be damaged by the processing for forming the spacers 50, 52. Preferably, the spacers 50, 52 are formed on the dielectric plate 54 before the dielectric plate 54 is mounted on the dielectric substrate 40.

With the spacers 50, 52 thus formed at the prescribed positions, the dielectric plate 54 is mounted on the dielectric substrate 40, whereby the gap 53 of a prescribed width is defined between the dielectric substrate 40 and the dielectric plate 54. At this time, the spacers 52 in the form of indium-silver alloy bumps, which have been formed thicker than the spacers 50 of clyclized rubber resin, is plastically deformed to be as thick as the spacers 50 of the clyclized rubber resin. The viscosity of the spacers 52 in the form of indium-silver alloy permits the dielectric plate 54 to be secured to the upper surface of the dielectric substrate 40.

When the size of the spacers 52 on the upper surface of the dielectric substrate 40 is too large, the spacers 52 often interfere with the resonance circuit. Accordingly, the maximum size of the spacers 52 on the upper surface of the dielectric substrate 40 is preferably below 1 mm including 1 mm.

The positions and the numbers of the spacers 50, 52 can be suitably changed in design in accordance with the size of the dielectric plate 24, etc.

As described above, according to the present embodiment, the dielectric plate 54 mounted on the dielectric substrate 40 with the spacers 50 of cyclized rubber resin and the spacers 52 in the form of indium-silver alloy bumps formed therebetween covers the region including the resonator patterns 46*a*–46*e* and the input/output feeders 44*a*, 44*b* over the length of positive integer times the ¼ effective wavelength from the sides nearer to the resonator patterns 46*a*, 46*e*, whereby the superconducting filter can be downsized, and the power characteristics can be improved with high repeatability.

In the superconducting filter according to the present embodiment as well, the metal pads may be formed on the upper surface of the dielectric substrate 40 and the underside of the dielectric plate 54 at the positions where the spacers 52 in the form of indium-silver alloy bumps are arranged, in the same way as in the superconducting filter according to the second embodiment.

A Fourth Embodiment

Figure 6:
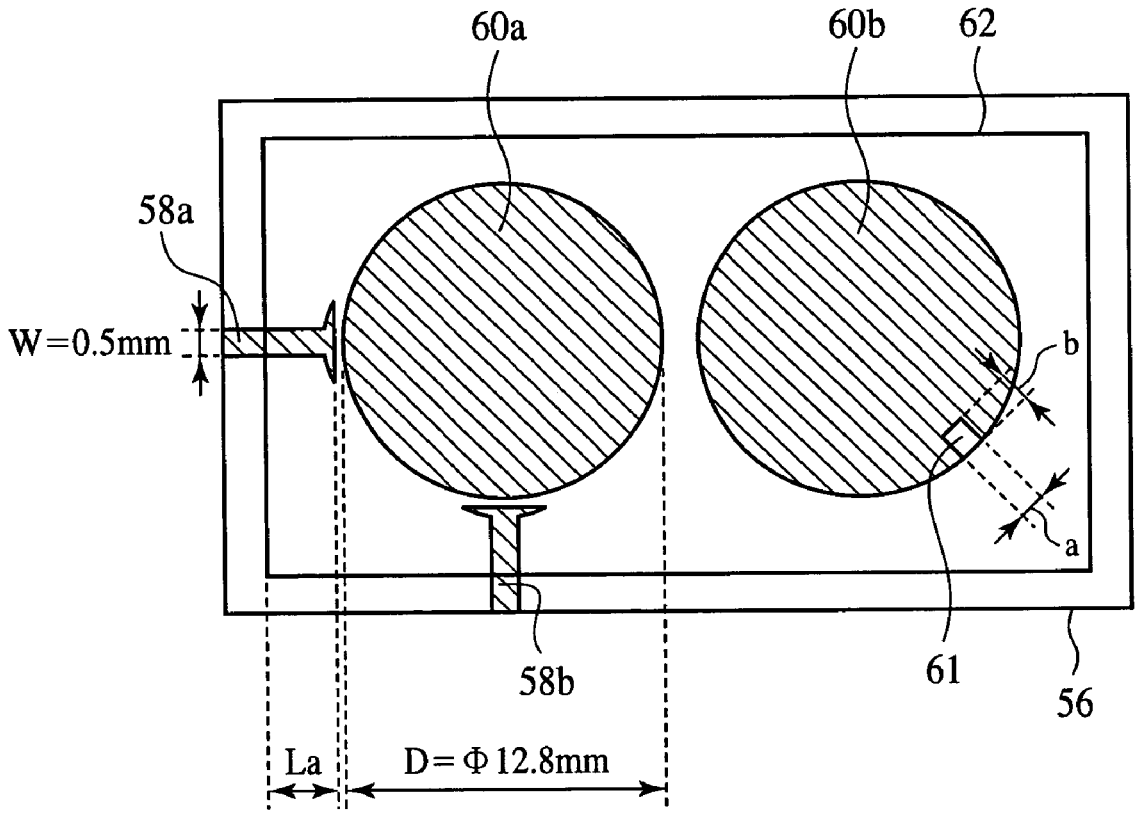
FIG. 6 is a plan view of the superconducting filter according to a fourth embodiment of the present invention, which illustrates a structure thereof.
Figure 7:
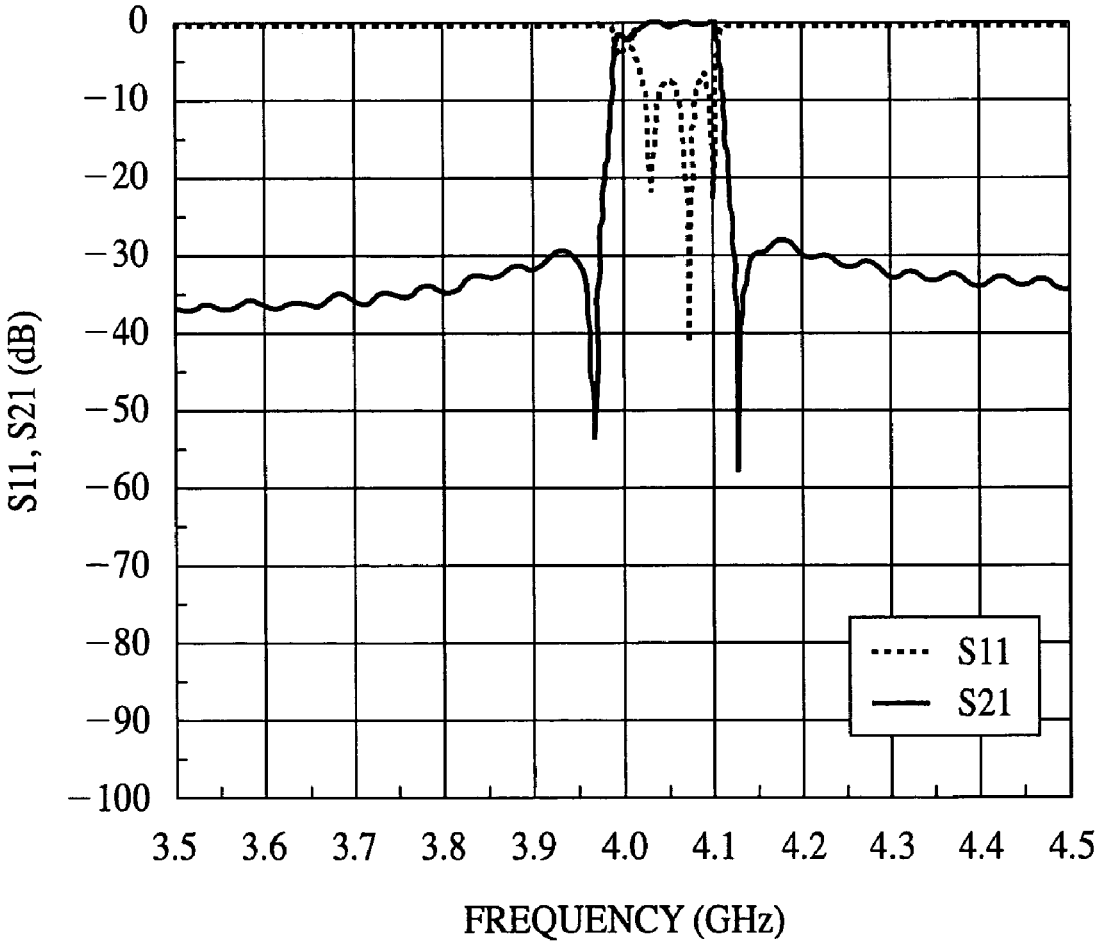
FIG. 7 is a graph of characteristics of the superconducting filter according to the fourth embodiment of the present invention.
Figure 8:
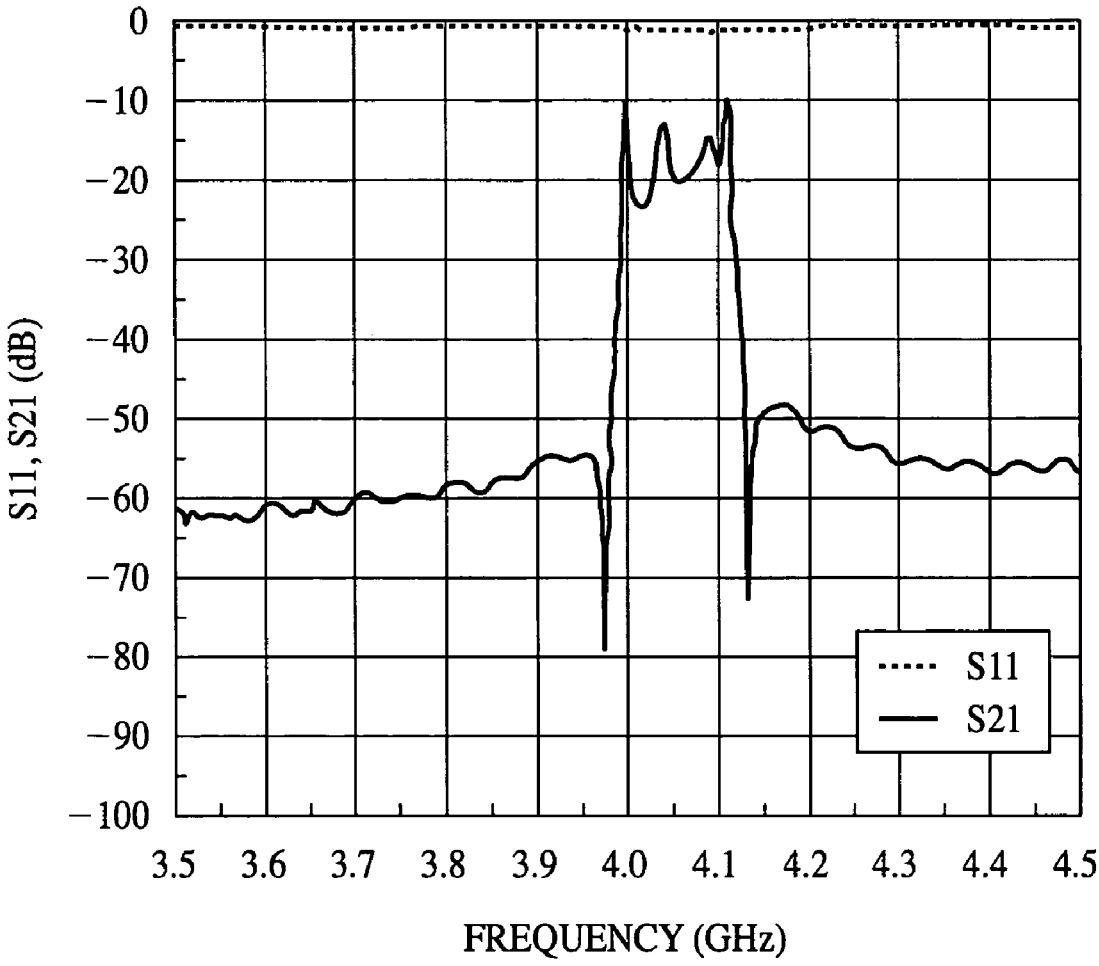
FIG. 8 is a graph of characteristics of the superconducting filter with the dielectric plate directly mounted on the dielectric substrate without the spacers.

The superconducting filter according to a fourth embodiment of the present invention will be explained with reference to FIGS. 6 to 8. FIG. 6 is a plan view of the superconducting filter according to the present embodiment, which illustrates a structure thereof. FIG. 7 is a graph of characteristics of the superconducting filter according to the present embodiment. FIG. 8 is a graph of characteristics of the superconducting filter with the dielectric plate mounted directly on the dielectric substrate without spacers.

The superconducting filter according to the present embodiment is a band-pass filter using disc patterns as the resonator patterns and includes 4 resonance points in the pass band. The center frequency of the pass band is, e.g., about 4 GHz. The bandwidth is, e.g., about 0.1 GHz.

As illustrated in FIG. 6, resonator patterns 60*a*, 60*b* of circular disc patterns are formed on the upper surface of the dielectric substrate 56 of magnesium oxide (100) single crystal. Cut concave pattern 61 is formed in the periphery of the resonator pattern 60*b*. Near the resonator pattern 60*a* there are formed an input feeder 58*a* to which radio-frequency signals are inputted and an output feeder 60*b* from which the filtered radio-frequency signals are outputted. A ground plane (not illustrated) is formed on the underside of the dielectric substrate 56. Thus, the microstrip transmission line structure is formed on the dielectric substrate 56. The input feeder 58*a*, the output feeder 58*b*, the resonator patterns 60*a*, 60*b* and the ground plane are formed of YBCO superconductor film deposited by, e.g., epitaxial growth. The thickness of the dielectric substrate 56 is, e.g., 0.5 mm. The width of the input feeder 58*a* is, e.g., 0.5 mm. The diameter of the resonator patterns 60*a*, 60*b* is, e.g., 12.8 mm.

On the upper surface of the dielectric substrate 56 with the input feeder 58*a*, the output feeder 58*b* and the resonator patterns 60*a*, 60*b* formed on, a dielectric plate 62 of lanthanum aluminate ($LaAlO_3$) is mounted with 2 kinds of spacers (not illustrated) formed therebetween, as in the superconducting filter according to the first to the third embodiments. The thickness of the dielectric plate 62 is, e.g., 0.5 mm.

As in the superconducting filter according to the first to the third embodiments, the dielectric plate 62 covers the input feeder 58*a* length-wise over the length of positive integer times the ¼ effective wavelength from the end nearer to the resonator pattern 60*a*. Similarly, the dielectric plate 62 covers the output feeder 58*b* length-wise over positive integer times the ¼ effective wavelength from the end nearer to the resonator pattern 60*a*.

The superconducting filter according to the present embodiment is characterized in that the dielectric plate 62 is mounted on the upper surface of the dielectric substrate 56 with the planar circuit type-resonance circuit formed on with 2 kinds of spacers formed therebetweeen, and the dielectric plate 62 covers the region including the resonator patterns 60*a*, 60*b* and covers the input feeder 58*a* and the output feeder 58*b* over the length of positive integer times the ¼ effective wavelength from the ends thereof nearer to the resonator pattern 60*a*. Thus, as does the superconducting filter according to the first to the third embodiments, the reflection of radio-frequency signals can be depressed, and the impedance matching between the circuit patterns can be easily made. Accordingly, the reactive power of radio-frequency signals inputted and outputted to and from the superconducting filter can be decreased, and the power characteristics can be improved.

The length of the input feeder 58*a* and the output feeder 58*b* covered by the dielectric plate 62 is not essentially precisely positive integer times the ¼ effective wavelength and may be within ±20% of positive integer times the ¼ effective wavelength.

The superconducting filter according to the present embodiment is characterized in that, as in the superconducting filter according to the first to the second embodiment, the dielectric plate 62 is mounted on the dielectric plate 62 with spacers for defining the width of the gap between the dielectric substrate 56 and the dielectric plate 62 and plastically deformable spacers for securing the dielectric plate 62 formed therebetween. Thus, as in the superconducting filter according to the first to the third embodiments, the offset between the dielectric substrate 56 and the dielectric plate 62 and the change of the width of the gap between the dielectric substrate 56 and the dielectric plate 62 can be depressed. Accordingly, the power characteristics can be improved with high repeatability.

In the superconducting filter according to the present embodiment, the radio-frequency signals inputted to the input feeder 58*a* are resonated by the resonator pattern 60*a*. Part of energy of the radio-frequency signals is transmitted to the resonator pattern 60*b* and similarly is resonated there. This resonance state can be multiplexed with the signals being resonated by the resonator pattern 60*a* to be taken out from the output feeder 58*b*. The double resonance mode can be generated by the cut concave pattern 61 in the resonator pattern 60*b*. For example, the width a and the depth b of the cut concave pattern 61 are suitably set to thereby change the frequency gap of the double resonance point. The length La of the input feeder 58*a* covered by the dielectric plate 62 is suitably set at about ¼ of an effective wavelength corresponding to a pass band frequency, whereby the reflection of radiofrequency signals due to the mounted dielectric plate 62 can be depressed. The length of the output feeder 58*b* covered by the dielectric plate 62 is also similarly set to thereby depress the reflection radio-frequency signals due to the mounted dielectric plate 62. Thus, the electric field concentration which tends to take place at the ends, etc. of the patterns of superconductor film can be mitigated by mounting the dielectric plate 62, and the superconducting filter can be superior in even in high power operation.

FIG. 7 is a graph of characteristics of the superconducting filter according to the present embodiment. FIG. 8 is a graph of characteristics of the superconducting filter with the dielectric plate directly mounted on the dielectric substrate without spacers therebetween. Both graphs indicate the transmission characteristics (S21) and the reflection characteristics (S11). FIG. 7 shows the characteristics of the superconducting filter according to the present embodiment in the case that the gap between the dielectric substrate 56 and the dielectric plate 62 is set at 4 μm. The superconducting filter which has provided the characteristics shown in FIG. 8 has the same structure as the superconducting filter according to the present embodiment except that the dielectric plate is mounted directly on the dielectric substrate without the 2 kinds of spacers disposed therebetween.

As shown in FIG. 8, it is found that in the case that the dielectric plate is directly mounted on the dielectric substrate without the spacers therebetween, almost all of the inputted radio-frequency signals are reflected near the pass center frequency, and the superconducting filter does not function as a filter. In contrast to this, as shown in FIG. 7, it is found that the superconducting filter according to the present embodiment has superior filter characteristics in comparison with the case that the dielectric plate is mounted without the spacers.

As described above, according to the present embodiment, as in the superconducting filter according to the first to the third embodiments, the dielectric plate 62 mounted on the dielectric substrate 56 with the 2 kinds of spacers therebetween covers the region including the resonator patterns 60*a*, 60*b*, and the input feeders 58*a* and the output feeder 58*b* over the length of positive integer times the ¼ effective wavelength from the ends nearer to the resonator pattern 60*a*, whereby the superconducting filter can be downsized, and the power characteristics can be improved with high repeatability.

Modified Embodiments

The present invention is not limited to the above-described embodiments and can cover other various modifications.

For example, the superconducting filter according to the above-described embodiments may be accommodated in electric conductor packages. Such accommodation of the superconducting filter in electric conductor packages makes it possible to prevent outer electromagnetic waves from interfering with the radio-frequency signals.

In the above-described embodiments, the circuit conductor materials of the resonance circuit formed on the dielectric substrate are YBCO superconductor and DyBCO superconductor. However, the circuit conductor materials are not limited to them and can be various. The circuit conductor materials of the resonance circuit can be oxide high temperature superconductors as of, e.g., BSCCO group expressed by $Bi_{n1}Sr_{n2}Ca_{n3}Cu_{n4}O_{n5}$ ($1.8 \leqq n1 \leqq 2.2$, $1.8 \leqq n2 \leqq 2.2$, $0.9 \leqq n3 \leqq 1.2$, $1.8 \leqq n4 \leqq 2.2$, $7.8 \leqq n5 \leqq 8.4$), PBSCCO group expressed by $Pb_{k1}Bi_{k2}Sr_{k3}Ca_{k4}Cu_{k5}O_{k6}$ ($1.8 \leqq k1+k2 \leqq 2.2$, $0 \leqq k1 \leqq 0.6$, $1.8 \leqq k3 \leqq 2.2$, $1.8 \leqq k4 \leqq 2.2$, $1.8 \leqq k5 \leqq 2.2$, $9.5 \leqq k6 \leqq 10.8$), RBCO group expressed by $R_pBa_qCu_rO_{7-\delta}$ (R is one of Y, Lu, Yb, Tm, Er, Ho, Dy, Eu, Sm, Nd, and $0.5 \leqq p \leqq 1.2$, $1.8 \leqq q \leqq 2.2$, $2.5 \leqq r \leqq 3.5$, $0 \leqq \delta \leqq 0.4$), and other groups. The RBCO group oxide high temperature superconductors with R=Y, p=1, q=2 and r=3 correspond to the circuit conductor materials of the superconducting filter according to the first and the second embodiments, and the RBCO group oxide temperature superconductors with R=Dy, p=1, q=2 and r=3 correspond to the circuit conductor materials of the superconducting filter according to the third embodiment. The RBCO oxide high temperature superconductors have higher critical temperatures $T_c$ as the composition has small δ values of below 0.1 including 0.1. Accordingly, it is preferable that the value of δ is below 0.1 including 0.1. The circuit conductor material of the resonance circuit can be, superconductor materials such as e.g., $MgB_2$, Nb, Nb—Ti alloy (the Ti content ratio is, e.g., about 50 at %) or others.

In the above-described embodiments, the dielectric substrate materials and the dielectric plate materials are magnesium oxide and rutile titanium oxide. However, the dielectric substrate material and the dielectric plate material are not limited to them, and, for example, alumina, sapphire, lanthanum aluminate, etc. in addition to magnesium oxide and rutile titanium oxide.

In the above-described embodiments, the spacers 20, 50 are formed of polyimide and cyclized rubber resin. However, the materials of the spacers 20, 50 are not limited to them. The materials of the spacers 20, 50 can be resins, such as, e.g., PMMA (poly(methyl methacrylate), novolak resin, etc. in addition to polyimide and clyclized rubber resin.

In the above-described embodiments, the spacers 22, 52 are formed of indium and indium-silver alloy, but the materials of the spacers 22, 52 are not limited to them. The materials of the spacers 22, 52 can be indium-tin alloy, indium-zinc alloy, indium-bismuth alloy, and other alloys in addition to indium and indium-silver alloy. The content ratio of the metal forming alloys with indium is, e.g., below 10 at % (atom percentage) including 10 at %.

In the above-described embodiments, the resonance circuit has 5 resonator patterns, but the number of the resonator patterns is not limited to the number. The number of the resonator patterns can be suitably changed in accordance with required frequency characteristics, etc.

In the above-described embodiments, circuit conductor patterns of the input/output feeders 14*a*, 14*b*, 44*a*, 44*b* and the resonator patterns 16*a*–16*e*, 46*a*–46*e* are linear distributed constant-type (wavelength resonance type) patterns are used, but the circuit conductor patterns are not limited to them. The circuit conductor patterns can be, e.g., modified linear patterns, in which linear patterns are branched or bent, and distributed constant-type patterns in patches of, e.g., circles, etc.

In the above-described embodiments, the dielectric plates 24, 54 are mounted on the upper surfaces of the dielectric substrates 10, 40, but the dielectric body, which does not necessarily has a plate-like shape, can be mounted on the dielectric substrate 10, 40.

What is claimed is:

1. A superconducting filter comprising:

a dielectric substrate;

an input feeder formed on one surface of the dielectric substrate and formed of a superconductor film, for inputting a radio-frequency signal;

a resonator pattern formed on said one surface of the dielectric substrate and formed of a superconductor film, for filtering the radio-frequency signal inputted from the input feeder;

an output feeder formed on said one surface of the dielectric substrate and formed of a superconductor film, for outputting the radio-frequency signal filtered by the resonator pattern; and a dielectric body mounted on said one surface of the dielectric substrate with a plurality of spacers disposed therebetween, the dielectric body covering a region including the resonator pattern, an end part of the input feeder on a side nearer the resonator pattern, the end part of the input feeder having a length not less than 80% of a positive integer multiple of a ¼ effective wavelength and not more than 120% of the positive integer multiple of the ¼ effective wavelength and an end part of the output feeder on a side nearer the resonator pattern, the end part of the output feeder having a length not less than 80% of the positive integer multiple of the ¼ effective wavelength and not more than 120% of the positive integer multiple of the ¼ effective wavelength, wherein the input feeder and the output feeder are partially covered by the dielectric body.

2. A superconducting filter according to claim 1, wherein said plurality of spacers include a first plastically deformable spacer securing the dielectric body mounted on said one surface of the dielectric substrate, and a second spacer for defining a width of a gap between the dielectric substrate and the dielectric body.

3. A superconducting filter according to claim 2, wherein the first spacer is formed of indium, indium-silver alloy, indium-tin alloy, indium-zinc alloy or indium-bismuth alloy.

4. A superconducting filter according to claim 2, wherein the first spacer comprises a first metal pad formed on said one surface of the dielectric substrate, a second metal pad formed on a surface of the dielectric body opposed to the dielectric substrate, and a bump which is sandwiched by the first metal pad and the second metal pad and is formed of indium, indium-silver alloy, indium-tin alloy, indium-zinc alloy or indium-bismuth alloy.

5. A superconducting filter according to claim 4, wherein the metal pad comprises a base metal layer of nickel or titanium, and a metal layer formed of gold, silver or copper on said base metal layer.

6. A superconducting filter according to claim 2, wherein the first spacer comprises a metal pad formed on said one surface of the dielectric substrate or a surface of the dielectric body opposed to the dielectric substrate, and a bump which is in contact with the metal pad and is formed of indium, indium-silver alloy, indium-tin alloy, indium-zinc alloy or indium-bismuth alloy.

7. A superconducting filter according to claim 6, wherein the metal pad comprises a base metal layer of nickel or titanium, and a metal layer formed of gold, silver or copper on said base metal layer.

8. A superconducting filter according to claim 2, wherein the second spacer is formed of polyimide, PMMA, novolac resin or cyclized rubber resin.

9. A superconducting filter according to claim 2, which further comprises:

a ground plane formed on the other surface of the dielectric substrate, and in which a microstrip-type planar circuit including the input feeder, the output feeder, the resonator pattern and the ground plane is formed.

10. A superconducting filter according to claim 2, which further comprises:

a ground plane formed on said one surface of the dielectric substrate, and in which a coplanar-type planar circuit including the input feeder, the output feeder, the resonator pattern and the ground plane is formed.

11. A superconducting filter according to claim 2, wherein the superconductor film is an oxide high temperature superconductor film.

12. A superconducting filter according to claim 2, wherein the dielectric body is alumina, sapphire, magnesium oxide, lanthanum aluminate or rutile titanium oxide.

13. A superconducting filter according to claim 2, wherein a circuit conductor pattern of the input/output feeder and/or the resonator pattern are in linear shape, a modified linear shape or a patch shape.

14. A superconducting filter according to claim 2, further comprising an electric conductor package for housing the dielectric substrate with the dielectric body mounted on.

15. A superconducting filter according to claim 1, which further comprises:

a ground plane formed on the other surface of the dielectric substrate, and in which a microstrip-type planar circuit including the input feeder, the output feeder, the resonator pattern and the ground plane is formed.

16. A superconducting filter according to claim 1, which further comprises:

a ground plane formed on said one surface of the dielectric substrate, and in which a coplanar-type planar circuit including the input feeder, the output feeder, the resonator pattern and the ground plane is formed.

17. A superconducting filter according to claim 1, wherein the superconductor film is an oxide high temperature superconductor film.

18. A superconducting filter according to claim 1, wherein the dielectric body is alumina, sapphire, magnesium oxide, lanthanum aluminate or rutile titanium oxide.

19. A superconducting filter according to claim 1, wherein a circuit conductor pattern of the input/output feeder and/or the resonator pattern are in linear shape, a modified linear shape or a patch shape.

20. A superconducting filter according to claim 1, further comprising an electric conductor package for housing the dielectric substrate with the dielectric body mounted on.

* * * * *